US010126000B2

(12) United States Patent
Limberg et al.

(10) Patent No.: US 10,126,000 B2
(45) **Date of Patent: *Nov. 13, 2018**

(54) DOWNDRAFT VENTILATION SYSTEMS AND METHODS

(71) Applicant: Broan Nu-Tone, LLC, Hartford, WI (US)

(72) Inventors: Kurt Limberg, Wauwatosa, WI (US); Brent Lillesand, Hartford, WI (US); Richard R. Sinur, West Bend, WI (US); Marjorie Schwanke, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/081,488

(22) Filed: Mar. 25, 2016

(65) Prior Publication Data

US 2016/0209049 A1 Jul. 21, 2016

Related U.S. Application Data

(63) Continuation-in-part of application No. 13/959,374, filed on Aug. 5, 2013, now Pat. No. 9,297,540, which is a continuation-in-part of application No. 13/887,028, filed on May 3, 2013.

(60) Provisional application No. 61/642,060, filed on May 3, 2012.

(51) Int. Cl.
*F24C 15/20* (2006.01)

(52) U.S. Cl.
CPC ..... *F24C 15/2085* (2013.01); *F24C 15/2021* (2013.01); *F24C 15/2042* (2013.01); *F24C 15/2092* (2013.01)

(58) Field of Classification Search
CPC ..... F24C 15/2085; F24C 15/2042; F24C 15/2092
USPC ..... 126/299 D; 454/63
See application file for complete search history.

(56) References Cited

U.S. PATENT DOCUMENTS 2,868,108 A * 1/1959 Petersen ..... F24C 15/20 126/299 D
3,011,492 A 12/1961 Humbert
3,043,290 A 7/1962 Gibbons
(Continued)

FOREIGN PATENT DOCUMENTS

CA 2814915 A1 11/2013
CN 2331883 Y 8/1999
(Continued)

OTHER PUBLICATIONS

"U.S. Appl. No. 13/887,028, Non Final Office Action dated Feb. 25, 2016", 17 pgs.
(Continued)

*Primary Examiner* — Gregory Huson
*Assistant Examiner* — Ryan Faulkner
(74) *Attorney, Agent, or Firm* — Barnes & Thornburg LLP

(57) ABSTRACT

A downdraft ventilation system includes a vertically movable chimney with two ventilation inlets and a baffle arranged within the chimney between the inlets. The combination of upper and lower ventilation inlets and internal baffle can function to increase the amount of cooking emission captured and exhausted by the downdraft system.

32 Claims, 15 Drawing Sheets

(56) References Cited

U.S. PATENT DOCUMENTS 3,409,005 A * 11/1968 Field ..... F24C 15/2042 126/299 R
3,712,819 A 1/1973 Filed
4,281,635 A * 8/1981 Gaylord ..... F24C 15/20 126/299 D
4,426,918 A * 1/1984 Lambert ..... F24F 13/12 454/298
4,501,260 A * 2/1985 Grace ..... F24C 15/2042 126/21 R
4,784,114 A * 11/1988 Muckler ..... F24C 15/20 126/299 D
4,934,337 A 6/1990 Falk
4,945,891 A * 8/1990 Cecil ..... F24C 15/2092 126/299 D
5,062,410 A * 11/1991 Sarnosky ..... F24C 15/2092 126/299 D
5,435,781 A * 7/1995 Kitchens ..... F24F 13/08 454/284
5,507,547 A * 4/1996 Hattass ..... F24F 13/12 296/211
5,690,093 A 11/1997 Schrank et al.
5,810,658 A * 9/1998 Seo ..... F24F 13/06 454/233
5,884,619 A * 3/1999 Terry ..... F24C 15/2042 126/299 D
6,276,358 B1 * 8/2001 Brin, Jr. ..... F24C 15/2085 108/106
D452,556 S 12/2001 Kurokawa et al.
6,455,818 B1 * 9/2002 Arntz ..... F24C 15/2042 126/299 R
6,604,520 B2 8/2003 Grimm et al.
6,698,419 B2 * 3/2004 Lee ..... B01D 47/021 126/299 D
7,836,877 B2 * 11/2010 Gagas ..... F24C 15/2042 126/1 R
7,947,123 B2 * 5/2011 Kwok ..... B01D 45/08 126/299 C
8,020,549 B2 * 9/2011 Huber ..... F24C 15/2042 126/299 D
8,312,873 B2 * 11/2012 Gagas ..... F24C 15/2035 126/299 D
8,857,424 B2 * 10/2014 Lambertson ..... B08B 15/02 126/299 D
9,010,313 B2 4/2015 Mikulec
9,297,540 B2 * 3/2016 Sinur ..... F24C 15/2042
2002/0029696 A1 3/2002 Grimm et al.
2003/0226559 A1 * 12/2003 Khosropour ..... F24C 15/2035 126/299 R
2004/0194777 A1 * 10/2004 Antoniello ..... F24C 15/20 126/299 R
2006/0278215 A1 * 12/2006 Gagas ..... F24C 15/2092 126/299 D
2007/0261693 A1 * 11/2007 Fortuna ..... F24C 15/2042 126/299 D
2007/0295324 A1 * 12/2007 Feisthammel ..... F24C 15/2021 126/299 D
2008/0029081 A1 2/2008 Gagas et al.
2009/0098820 A1 * 4/2009 Yabu ..... F24F 1/0011 454/333
2009/0137201 A1 5/2009 Huber et al.
2009/0156112 A1 * 6/2009 Kubota ..... A61B 90/40 454/56
2009/0241934 A1 * 10/2009 Canavari ..... F24C 15/2092 126/299 D
2010/0012110 A1 * 1/2010 Feisthammel ..... F24C 15/2042 126/299 D
2010/0059040 A1 * 3/2010 Shaffer ..... F24C 15/2092 126/299 D
2010/0065038 A1 * 3/2010 Davies ..... F24C 15/2092 126/299 D
2010/0116263 A1 5/2010 Bruckbauer
2010/0126494 A1 * 5/2010 Lambertson ..... B08B 15/02 126/299 D
2010/0163549 A1 7/2010 Gagas et al.
2012/0152227 A1 * 6/2012 Oagley ..... F24C 15/2064 126/299 D
2012/0204855 A1 * 8/2012 Huber ..... F24C 15/2035 126/299 R
2013/0125764 A1 * 5/2013 Jeong ..... F24C 15/2035 99/357
2013/0133639 A1 * 5/2013 Lee ..... F24C 15/2035 126/299 D
2013/0319400 A1 12/2013 Langenbach et al.
2014/0034040 A1 2/2014 Sinur et al.
2014/0041649 A1 2/2014 Sinur et al.

FOREIGN PATENT DOCUMENTS

DE 102009025038 A1 12/2010
JP 5918232 U 2/1984
JP 2005106374 A 4/2005
WO WO-2011080097 A2 7/2011
WO WO-2013166445 A1 11/2013

OTHER PUBLICATIONS

"U.S. Appl. No. 13/887,028, Non Final Office Action dated Oct. 15, 2015", 12 pgs.
"U.S. Appl. No. 13/887,028, Response filed Jan. 15, 2016 to Non Final Office Action dated Oct. 15, 2015", 13 pgs.
"U.S. Appl. No. 13/959,374, Corrected Notice of Allowance dated Feb. 12, 2016", 2 pgs.
"U.S. Appl. No. 13/959,374, Non Final Office Action dated Jun. 5, 2015", 11 pgs.
"U.S. Appl. No. 13/959,374, Notice of Allowance dated Nov. 19, 2015", 8 pgs.
"U.S. Appl. No. 13/959,374, Response filed Sep. 4, 2015 to Non Final Office Action dated Jun. 5, 2015", 11 pgs.
"Chinese Application Serial No. 201380032413.1, Office Action dated Dec. 23, 2015", 17 pgs
"European Application Serial No. 13784786.9, Extended European Search Report dated Dec. 4, 2015", 8 pgs.
"European Application Serial No. 13784786.9, Office Action dated Dec. 10, 2014", 3 pgs.
"European Application Serial No. 13784786.9, Response filed Jun. 17, 2015 to Office Action dated Dec. 10, 2014", 8 pgs.
"International Application Serial No. PCT/US2013/039554, International Preliminary Report on Patentability dated Nov. 13, 2014", 8 pgs.
"International Application Serial No. PCT/US2013/039554, International Search Report dated Sep. 27, 2013", 3 pgs.
"International Application Serial No. PCT/US2013/039554, Written Opinion dated Sep. 27, 2013".
Examination Report No. 1 dated May 31, 2016 in Australian Patent Application No. 2014259588.
Response to Examination Report filed Feb. 9, 2017 in Australian Patent Application No. 2014259588.
Examination Report No. 1 dated Feb. 16, 2017 in Australian Patent Application No. 2013256025.
Office Action dated Mar. 14, 2016 in Canadian Patent Application No. 2870278.
Response to Office Action filed Sep. 14, 2016 in Canadian Patent Application No. 2870278.
Office Action dated Jan. 31, 2017 in Canadian Patent Application No. 2870278.
Response to Office Action filed Jul. 31, 2017 in Canadian Patent Application No. 2870278.
Response to First Office Action filed May 6, 2016 in Chinese Patent Application No. 201380032413.1 (Translation of Amended Claims Only).
Second Office Action dated Aug. 11, 2016 in Chinese Patent Application No. 201380032413.1.

(56) References Cited

OTHER PUBLICATIONS

Response to Second Office Action filed Oct. 26, 2016 in Chinese Patent Application No. 201380032413.1 (Translation of Amended Claims Only).
Third Office Action dated Feb. 21, 2017 in Chinese Patent Application No. 201380032413.1.
Response to Third Office Action filed Jul. 10, 2017 in Chinese Patent Application No. 201380032413.1 (Translation of Amended Claims Only).
Fourth Office Action dated Nov. 6, 2017 in Chinese Patent Application No. 201380032413.1.
Office Action dated Dec. 14, 2016 in European Patent Application No. 13784786.9.
Response to European Office Action filed Jun. 21, 2017 in European Patent Application No. 13784786.9.

* cited by examiner

Shadowgraph of example dual vent downdraft without internal baffle

Shadowgraph of example dual vent downdraft
with internal baffle (10 of 60 seconds)

Shadowgraph of example dual vent downdraft
with internal baffle (20 of 60 seconds)

Shadowgraph of example dual vent downdraft
with internal baffle (30 of 60 seconds)

Shadowgraph of example dual vent downdraft
with internal baffle (40 of 60 seconds)

Shadowgraph of example dual vent downdraft
with internal baffle (50 of 60 seconds)

Shadowgraph of example dual vent downdraft
with internal baffle (60 seconds)

DOWNDRAFT VENTILATION SYSTEMS AND METHODS

BACKGROUND

This disclosure relates generally to downdraft ventilation systems and methods.

Ventilation systems are commonly employed to capture and exhaust cooking emissions emanating from a cooking surface. For example, a ventilation system including a fan is disposed adjacent a cooking appliance, like, for example, an electric, gas, or induction cooktop appliance. The ventilation system is configured to draw cooking emissions into and exhaust the emissions from the system. Examples of such ventilation systems including vent hoods arranged above the cooking area of the cooking appliance and downdraft systems that are arranged next to, for example, behind and extending up from the cooking appliance.

The desire for ventilation solutions that do not significantly interfere with kitchen sight-lines can drive consumer demand for downdraft ventilation systems. Some consumers, for example, desire a smaller kitchen footprint with products that do not obstruct, block, or close-off spaces within the kitchen. At least some downdraft systems can be disposed in a kitchen island or peninsula and can raise and lower relative to a kitchen counter, which can result in significant portions of the ventilation system being hidden when not in use. However, because of the natural tendency of cooking emissions to flow vertically up from the cooktop or other appliance and because of the arrangement of downdraft vents adjacent to but not above the emission plume, improving the emission capture capability of downdraft systems is a common design challenge and goal for such ventilation systems.

SUMMARY

Examples according to this disclosure are directed to downdraft ventilation systems and methods with improved cooking emission capture capacity. In one example, a downdraft ventilation system includes a vertically movable chimney with two ventilation inlets and a baffle arranged within the chimney between the two ventilation inlets. The baffle within the chimney can include a single integral baffle or the baffle can include multiple, separate, and/or connected components, which together are arranged within the chimney to form a baffle advantageously affecting the capture capacity of the downdraft system. The combination of upper and lower ventilation inlets and internal baffle can function to increase the amount of cooking emission captured and exhausted by downdraft systems in accordance with this disclosure.

The details of examples of the disclosure are set forth in the accompanying drawings and the description below. Other features, components, and advantages of examples according to this disclosure will be apparent from the description and drawings, and from the claims.

DETAILED DESCRIPTION

A downdraft ventilation system can include a vertical chimney, which forms a cooking emission flow path from the area adjacent a cooking appliance to an exhaust duct connected to the ventilation system. The chimney can be vertically moveable to raise the chimney above the cooking appliance top surface and expose ventilation inlet(s) into the chimney when the downdraft system is activated to ventilate cooking emissions from the cooking appliance.

In examples according to this disclosure, a downdraft ventilation system includes a vertically movable chimney with two ventilation inlets and a baffle arranged within the chimney between the two ventilation inlets. The downdraft system can include an air/gas/emissions movement device, including, for example a blower fan, which is configured to draw cooking emissions from the cooking appliance into and through the chimney. The cooking emissions can be exhausted out of the space including the cooking appliance, including exhausting the emissions outside of the building within which the cooking appliance is arranged. The combination of upper and lower ventilation inlet and internal baffle can function to increase the amount of cooking emissions captured and exhausted by downdraft systems in accordance with this disclosure.

Figure 1:
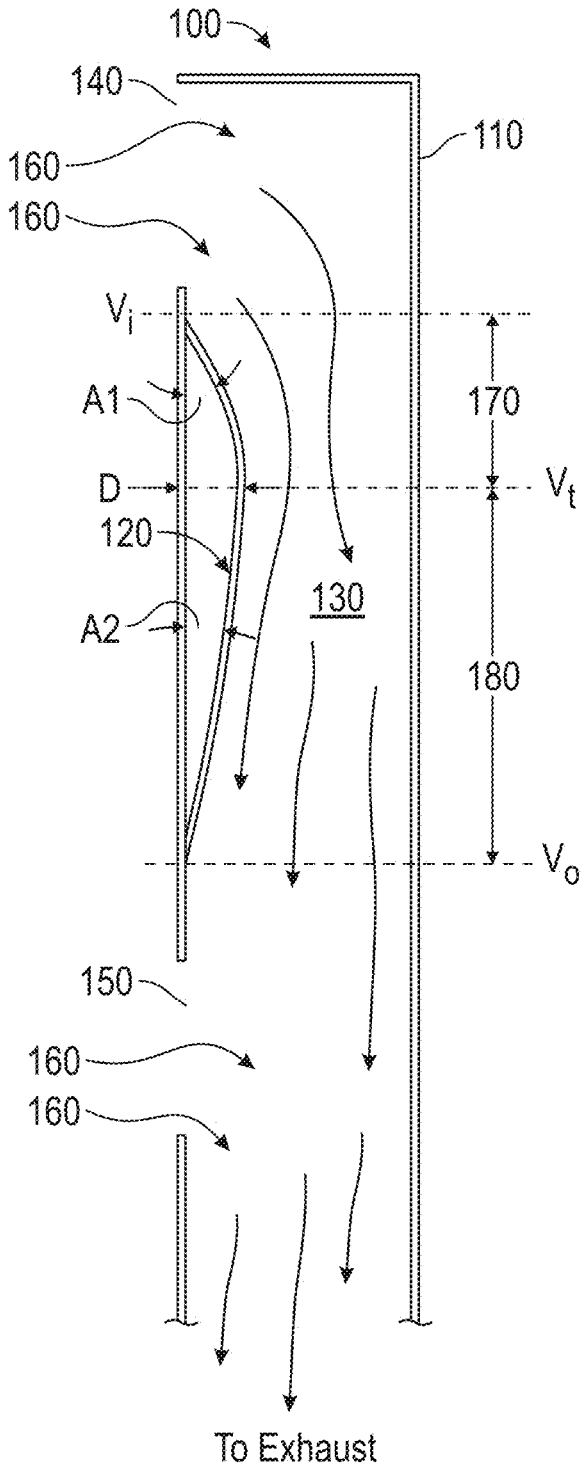
FIG. 1 is a schematic depicting a partial cross-section of an example downdraft system.

FIG. 1 is a schematic depicting a partial cross-section of an example downdraft system 100. Although not shown in FIG. 1, downdraft system 100 can be installed adjacent to a cooking area (e.g., in a kitchen) and positioned adjacent to and/or coupled with a cooking appliance and can be configured to capture and exhaust cooking emissions emanating from the cooking appliance. For example, in some examples, downdraft system 100 can be installed immediately adjacent to a cooktop appliance. In some examples, at least some portions of downdraft system 100 (e.g., fluid box, chimney movement assembly, and/or fluid outlets/exhaust vents can be installed substantially or completely under a counter surface and/or the top surface of the cooking appliance.

Downdraft system 100 can be installed and/or used in portions of a structure (for example, a home) other than the kitchen. For example, downdraft system 100 can be used in a workshop or any other area that could require ventilation (e.g., a laundry, a basement, a bathroom, etc.). Accordingly, although some examples of downdraft systems in accordance with this disclosure are described and illustrated as installed in a kitchen area (e.g., adjacent to a cooktop), in other examples, downdraft systems in accordance with this disclosure can be employed in other cooking-related and/or ventilation-related applications.

Referring to FIG. 1, downdraft system 100 includes a vertically moveable chimney 110 and a baffle 120. Chimney 110 defines a chamber 130 into and through which cooking emissions from a cooking appliance (not shown in FIG. 1) can be drawn to be exhausted through ventilation ducting coupled to the chimney or coupled to another portion of downdraft system 100 that is coupled to the chimney. Chimney 110 also includes two fluid inlets or vents, 140 and 150. Upper vent 140 is generally arranged vertically toward the top of chimney 110 and lower vent 150 is generally arranged vertically toward the bottom of chimney 110 in proximity/adjacent to the top of a cooking appliance. Baffle 120 is arranged within chimney 110 and disposed vertically between upper vent 140 and lower vent 150.

Cooking emissions 160 are depicted in FIG. 1 as being drawn into and ventilated through chimney 110. For example, cooking emissions 160 from a cooking appliance arranged adjacent downdraft 100 are drawn into upper and lower vents, 140 and 150, respectively, using a blower fan assembly (not shown in FIG. 1). Interposing baffle 120 between upper and lower vents, 140 and 150 within chimney 110 can improve the fluid flow characteristics of the cooking emissions into and through the chimney, which can, in turn, improve the capture efficiency of example downdraft system 100 and other downdraft systems in accordance with this disclosure.

Example baffle 120 is an elongated, relatively thin plate, which is arranged within and extends laterally across (e.g., from left to right when viewing downdraft from front) chimney 110. In the vertical direction, baffle 120 is curved such that, when arranged within chimney 110 as illustrated in FIG. 1, baffle 120 forms a converging section 170 from the "venturi inlet," Vi, to "venturi throat," Vt, and forms a diverging section 180 from Vt to the "venturi outlet," Vo. Thus, baffle 120 disposed within chimney 110 defines a fluid flow path that may exhibit characteristics similar to or the same as a structure commonly referred to as a venturi tube.

The manner in which baffle 120 affects the flow of cooking emissions into and through chimney 110 depends at least in part on a number of geometrical variables of the baffle, including angle, A1, defining converging section 170, angle, A2, defining diverging section 180, and D the distance from the inner wall of the chimney to the apex of baffle 120. In one example, convergent angle A1 is in a range from and including approximately 30 degrees to and including 40 degrees. In one example, convergent angle A1 is approximately equal to 33 degrees. In one example, divergent angle A2 is in a range from and including approximately 5 degrees to and including 15 degrees. In one example, divergent angle A2 is approximately equal to 11 degrees. In one example, D is in a range from and including 25% of the overall depth of chimney 110 to and including 75% of the overall depth of the chimney.

Baffle 120 can include a single, integral component that functions to advantageously affect fluid flow through chimney 110, which, in turn, can improve the emissions capture capabilities of downdraft system 100. In another example, however, baffle 120 can include multiple separate and/or connected components. An example of a downdraft system with an internal baffle including two elongated plates similar to the plate of baffle 120 depicted in FIG. 1 is described and illustrated with reference to FIG. 3. However, all of the examples of this application including internal baffles can include a single, integral component mounted within a downdraft chimney to advantageously affect fluid flow there through, or, alternatively, the example baffles can be made up of multiple components arranged within the chimney and together forming the internal baffle.

Figure 2:
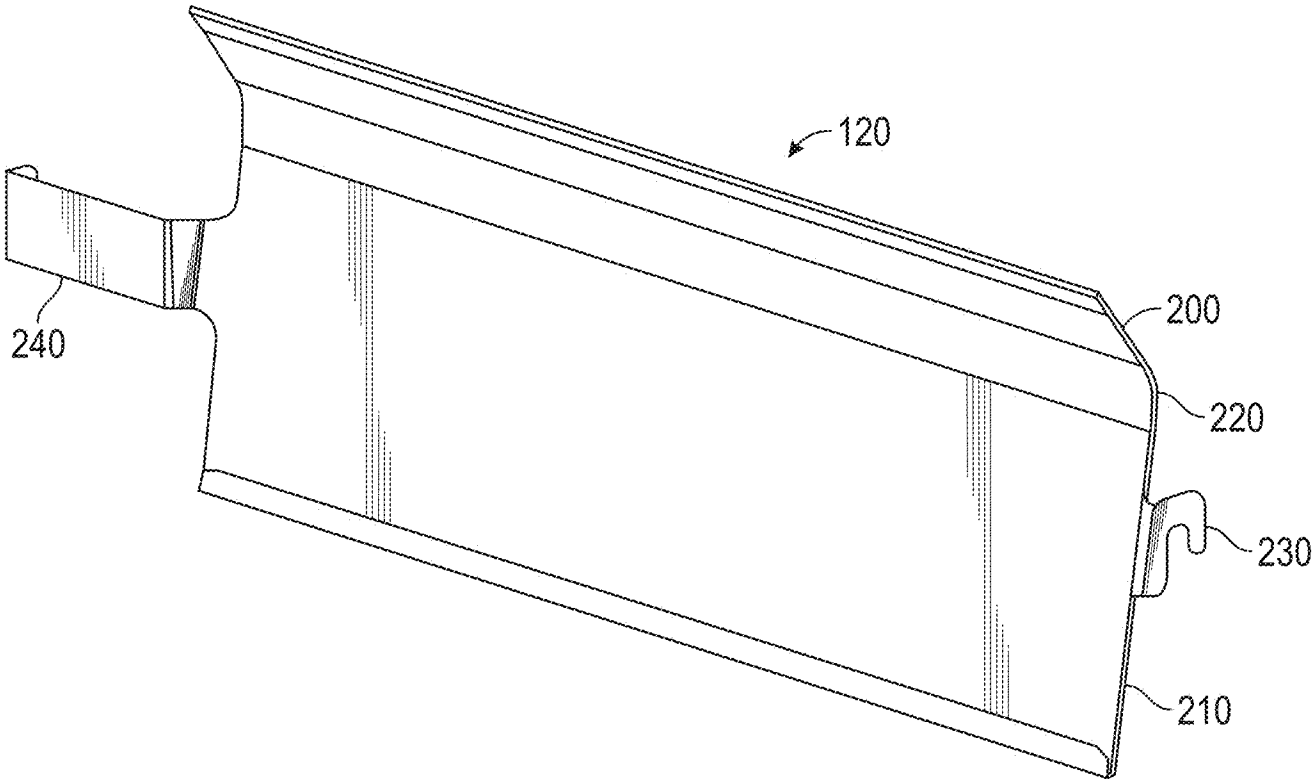
FIG. 2 is a perspective view depicting an example baffle.

FIG. 2 is a perspective view depicting example baffle 120. Example baffle 120 is an elongated, relatively thin plate, which includes upper section 200, lower section 210, and curved middle section 220. Baffle 120 includes mounting flanges 230 and 240, extending from opposite sides of the baffle. Upper section 200 of baffle 120 can be generally flat or curved. Similarly, lower section 200 can be generally flat or curved. Regardless, when baffle 120 is arranged within chimney 110 as illustrated in FIG. 1, the connected or integral upper, lower, and middle sections 200, 210, and 220, respectively, form a converging section and forms a diverging section that define a fluid flow path within the chimney that may exhibit characteristics similar to or the same as a venturi tube. Mounting flanges 230 and 240 are used to connect baffle 120 within chimney 110.

Figure 3:
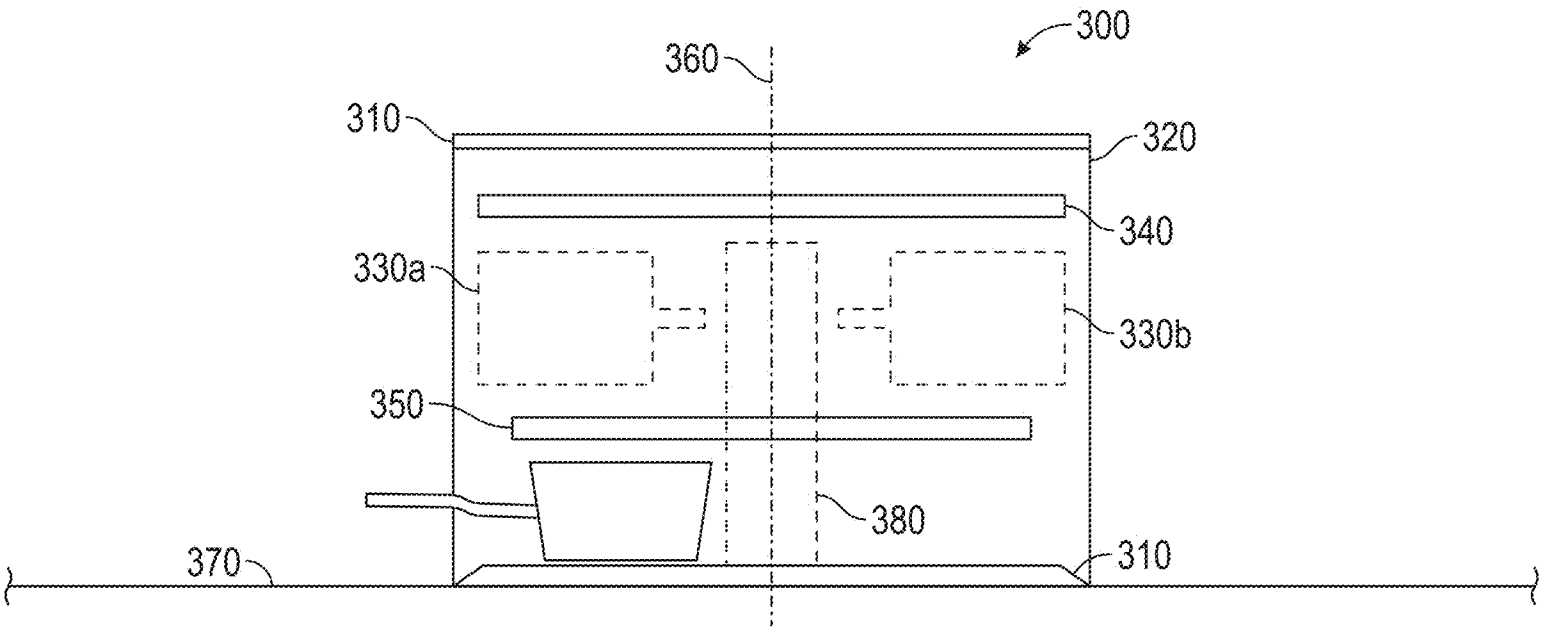
FIG. 3 is a schematic elevation view depicting an example downdraft system arranged adjacent a cooktop appliance.

FIG. 3 is a schematic elevation view depicting an example downdraft system 300 arranged adjacent a cooktop appliance 310. Downdraft system 300 includes visor 310, chimney 320, and baffle 330 arranged within chimney 320. Chimney 320 includes upper vent 340 and lower vent 350. Additionally, downdraft system 300 includes vertical column 380. Column 380 represents a structure, including, for example, a housing within which an actuator of the movement assembly/mechanism that raises and lowers chimney 320 is arranged. For example, a linear actuator may be arranged within or at column 380.

As illustrated in FIG. 3, internal baffle 330 includes two elongated baffle plates 330*a*, 330*b* arranged in a vertically aligned position on opposite sides of a vertical axis 360 and also column 380. The presence of column 380 housing, for example, a linear actuator for raising and lowering chimney 320 may necessitate the use of multiple components cooperatively arranged to form baffle 330, like, for example, baffle plates 330*a*, 330*b*. Each of baffle plates 330*a*, 330*b*, in this example, may be substantially similar to example baffle 120 of FIGS. 1 and 2. In another example similar to the example of FIG. 3, baffle 330 can include a single elongated plate similar to baffle 120, which extends across a portion or all of the width of chimney 320 of downdraft system 300. Additionally, in other examples, the baffle employed in example downdraft systems may include more than two baffle plates or other structures mounted within the chimney and together forming the internal baffle that advantageously affects fluid flow through the chimney and to the exhaust ducting connected to the downdraft.

Cooking emissions from cooktop 310 can be drawn into upper and lower vents, 340 and 350 using a blower fan or other air mover device (not shown in FIG. 1). The cooking emissions can be further drawn through chimney 320 and exhausted through an exhaust duct connected directly or indirectly to the chimney. Each of baffle 330, upper vent 340, and lower vent 350 can provide distinct but related functions affecting the capture efficiency of downdraft system 300. For example, lower vent 350 can function to start moving the aggregate cooking emissions (referred to hereinafter as cooking plume) from the source of the emissions (e.g., a pot or pan on top of cooktop 310) back (into the paper from the perspective of FIG. 3) toward the front surface of chimney 310. An additional effect/function of lower vent 350 is to draw cooking emissions from the cooking plume into chimney 320. Similarly, upper vent 340 may function to draw cooking emissions of the cooking plume into chimney 320 and may also move the cooking plume from the source of the emissions back toward the front surface of chimney 310.

Interposing baffle 330 between upper and lower vents, 340 and 350 within chimney 320 can improve the fluid flow characteristics of the cooking emissions into and through the chimney, which can, in turn, improve the capture efficiency of example downdraft system 300. For example, emission flow through the converging and diverging sections defined by baffle 330 may be more uniform and laminar (i.e., less turbulent flow, which, in turn, can increase the efficiency with which cooking emissions are captured from and exhausted away from the region proximal to the cooking appliance. More generally, in some examples, venturi geometry is incorporated into a baffle disposed in the cooking emission flow path to create a relatively low pressure and high velocity fluid flow entry zone, which creates a suction path to capture and exhaust more cooking emissions than would be captured and exhausted by a similar downdraft system without an internal baffle. Additionally, in some examples, baffle 330 may effectively reduce the rate at which the cooking plume rises above cooktop 310 by increasing the volume of cooking emissions flowing through lower vent 350.

The height, width, and vertical and horizontal arrangement of and number of components include in baffle 330 can be varied to adjust the fluid flow performance characteristics of downdraft system 300. For example, baffle 330 including baffle plates 330*a*, 330*b*, and other baffles in accordance with this disclosure can be sized to extend laterally (e.g., left to right from the perspective of FIG. 3) across the entire width of the chimney 320 or across only a portion thereof. Additionally, in situations in which the baffle does not extend across the entire width of the chimney, and/or in which the baffle includes multiple separate and/or connected components, arranging the baffle in different lateral positions within the chimney can affect the fluid flow characteristics produced thereby. For example, in FIG. 3, baffle 330 includes baffle plates 330*a*, 330*b*, which are arranged on opposite sides of axis 360 and extend partially from or close to the right and left edges of upper vent 340 to just short of the vertical axis 360, which is aligned with the lateral middle of chimney 320. in such an arrangement, baffle 330 including baffle plates 330*a*, 330*b* may reduce cooking plume dispersal by biasing cooking emission flow toward the lateral middle of upper and lower vents 340 and 350, respectively.

In operation, when downdraft system 300 is in an inactive state, chimney 320 can be in a substantially or completely lowered position. For example, chimney 320 can be lowered so that the top of visor 310 substantially flush with or lower than a kitchen (or other room/cabinet) counter surface 370. As a result, when in an inactive state, most or substantially all chimney 320 can be located under or flush with counter surface 370 and not visible or less visible to a user (providing what some users may consider a pleasant aesthetic experience).

In order to exhaust at least a portion of cooking effluent and other fluids produced during a cooking episode, a movement assembly or mechanism can be activated (e.g., manually or automatically) to move chimney 320 vertically up from counter surface 370. For example, upon activation downdraft 300, chimney 320 can be raised above the counter surface 370 so that upper and lower vents 340 and 350 are in fluid communication with the local environment. Downdraft system 300 (and other downdraft systems in accordance with this disclosure) can include one or more ventilation assemblies, including, for example, fans or other devices configured to move fluids, such as air and cooking effluent. In examples, downdraft system 300 can include a fluid flow path leading from upper and lower vents 340 and 350 and chimney 320, through a ventilation assembly, and out of the downdraft system via one or more fluid outlets and/or fluid flow conduits/ducting (not shown).

A ventilation assembly of downdraft system 300 can be activated (e.g., manually or automatically) to draw in and capture cooking emissions and to exhaust such emissions and/or other fluids. For example, at least a portion of the cooking effluent captured by downdraft 300 can exit the system via the one or more fluid outlets and/or fluid flow conduits/ducting connected directly or indirectly to chimney 320. Such fluid outlets and/or exhaust ducting can be in fluid communication with a conventional ventilation network of the structure into which downdraft system 300 is installed or can be directly coupled to an exhaust that can direct the exhausted effluent to a desired location (e.g., out of structure, out of the local environment, through a toe kick-plate of a lower cabinet adjacent to or remote from the downdraft, etc.). Downdraft system 300 can include one or more filters disposed along the fluid flow path to remove at least some portions of the effluent that may be desirable not to exhaust from the system.

Downdraft system 300 includes two fluid/cooking emissions inlets, upper vent 340 and lower vent 350. However, in other examples, a downdraft system in accordance with this disclosure may include more than two vertically dispersed fluid flow inlets. Additionally, in some cases, the upper and/or lower vents (and other vents if present) may be comprised of a single or multiple apertures. In other words, in examples, the chimney of the downdraft system can include a first set of multiple apertures commonly arranged toward the upper portion of the chimney and a second set of multiple apertures commonly arranged toward the lower portion of the chimney closer to the cooking appliance adjacent the downdraft. Additionally, the size, shape, and relative arrangement of the single or multiple apertures in the chimney that form one or both of the upper and lower vents (and other vents if present) can vary.

Figure 4A:
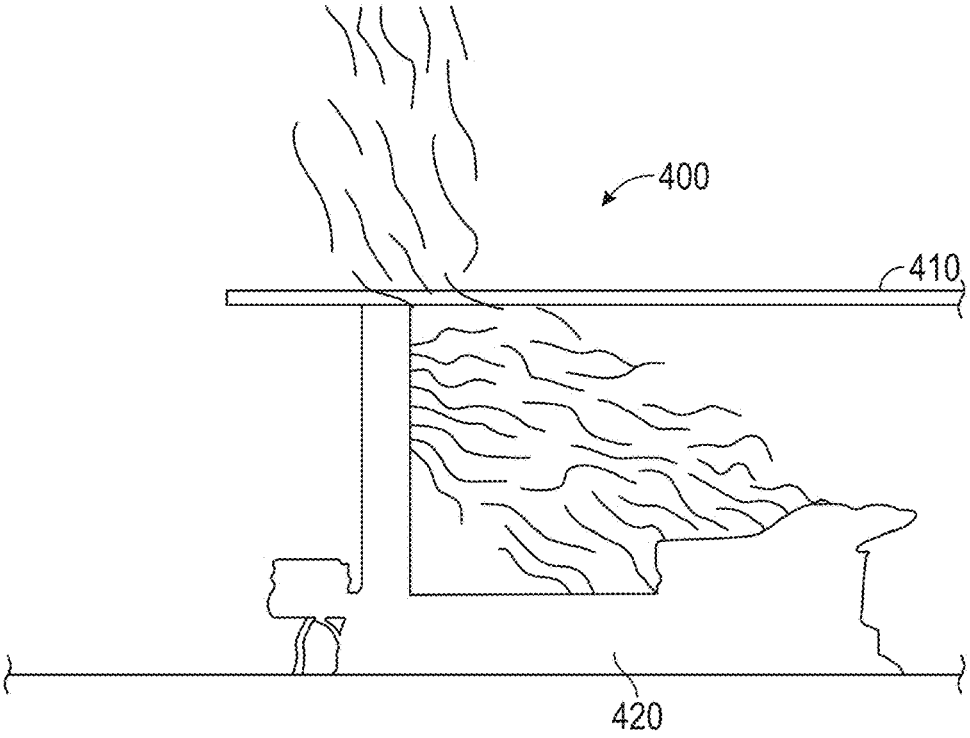
FIG. 4A (Prior Art)
FIGS. 4A and 4B are schematic elevations of two different downdraft systems illustrating the capture efficiency of each system.
Figure 4B:
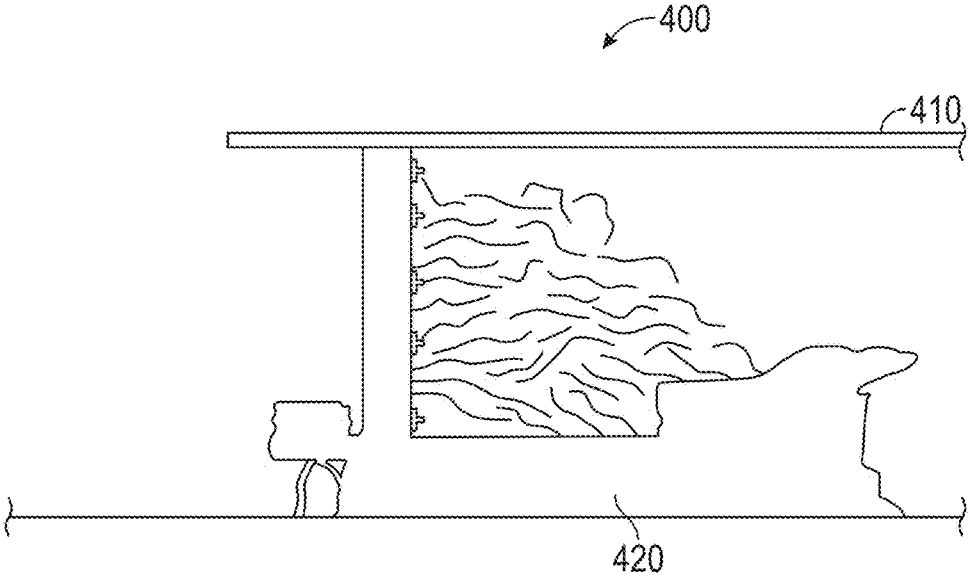

FIGS. 4A and 4B are schematic elevations of two different downdraft systems, which visually illustrate the capture efficiencies of each system relative to the other. FIG. 4A depicts a hypothetical, actual prior art downdraft system 400*a* that imperfectly (i.e., not 100% capture) captures cooking effluent from an adjacent cooking appliance. FIG. 4B is a theoretical, ideal downdraft system 400*b* that captures 100% of the cooking effluent emanating from the cooking appliance. The downdraft system 400*b* is therefore a benchmark system against which cooking emission capture capabilities of other downdraft systems can be compared.

In FIGS. 4A and 4B, horizontal datum 410 is a reference element generally indicating a horizontal plane below which is a cooking emission capture region in which cooking emissions are capable of being captured by the downdraft system and above which is a spillage region in which cooking emissions are deemed to have spilled or leaked out of the capture region and are therefore not captured by the downdraft system. As can be seen by comparing the examples of FIGS. 4A and 4B, downdraft system 400*b* captures 100% of the cooking emissions emanating from cooking appliance 420, while downdraft system 400, which is more illustrative of prior commercially available downdraft systems, captures less than 100% of the cooking emissions and exhibits a non-trivial amount of cooking emission spillage above datum 420.

FIGS. 5 and 6A-6F include a number of images that were taken during a number of tests run on two different downdraft systems. The downdraft system of FIG. 5 was a BEST Range Hoods LLC model D49M36SB downdraft ventilation system. This system has dual ventilation inlets in the chimney, but does not include any internal baffle or other fluid flow apparatus within the chimney. The downdraft of FIGS. 6A-6F is also a BEST model D49M36SB, but this system includes a pair of baffle plates within the chimney that are substantially similar to the examples of FIGS. 1, 2 and 3. The images for each test, the test of FIG. 5 and the test of FIGS. 6A-6F were captured every 10 seconds in a 60 second video utilizing shadowgraph flow visualization techniques. However, we are presenting only one image from the test of FIG. 5, which is illustrative of the relative capture performance of this system. All downdrafts in these tests were operated at high speed at 0.1" static pressure (which is representative of an industry standard operating point for purposes of rating range hood exhaust capacity). A standard residential 36" Gas cooktop was used for all tests. The burners were set to the same level/output, and equivalent/appropriately-sized pots half-filled with deionized water were used.

The pots were placed on the front burners of the cooktop for the test—this configuration was determined by previously completing a "cooktop usage" study which revealed that the typical consumer uses only the front burners for the majority of their cooking. After the water was brought to a steady-state boil condition, the shadowgraph video was taken. Note that shadowgraph imagery is not currently used to validate capture capability of residential range hoods, but the technique is used in a similar capacity to understand capture capabilities of commercial cooking ventilation systems.

Figure 5:
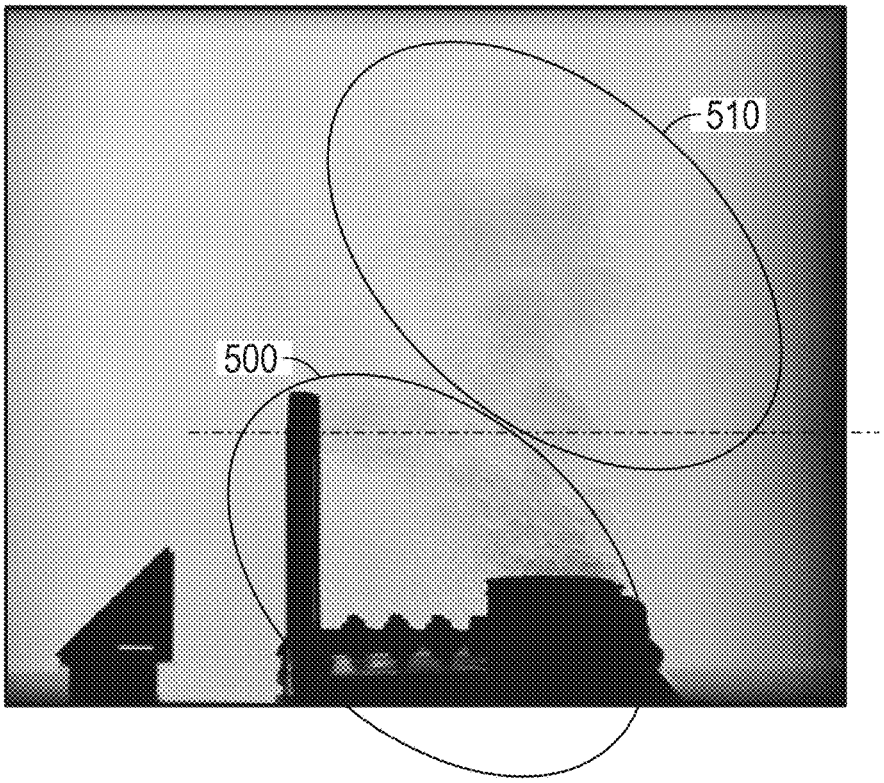
FIG. 5 (Prior Art)
FIG. 5 is a shadowgraph image of a test run on an actual prior art downdraft system operating to capture cooking emissions from an adjacent cooking appliance.
Figure 6A:
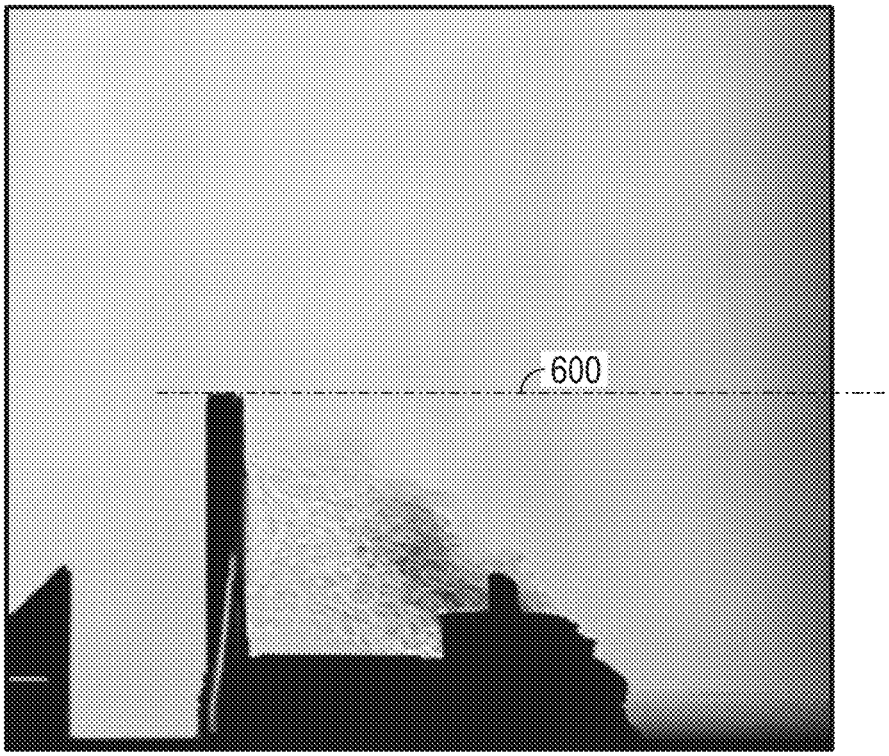
FIGS. 6A-6F are shadowgraph images of a test run on an actual example downdraft system in accordance with this disclosure, which system is operating to capture cooking emissions from an adjacent cooking appliance.
Figure 6B:
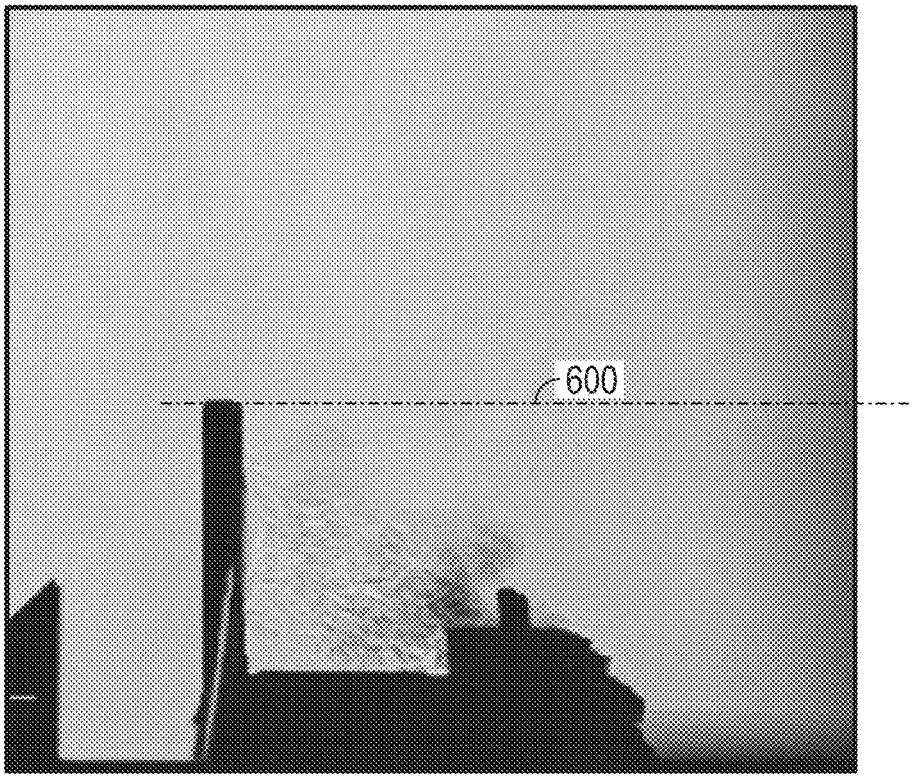
Figure 6C:
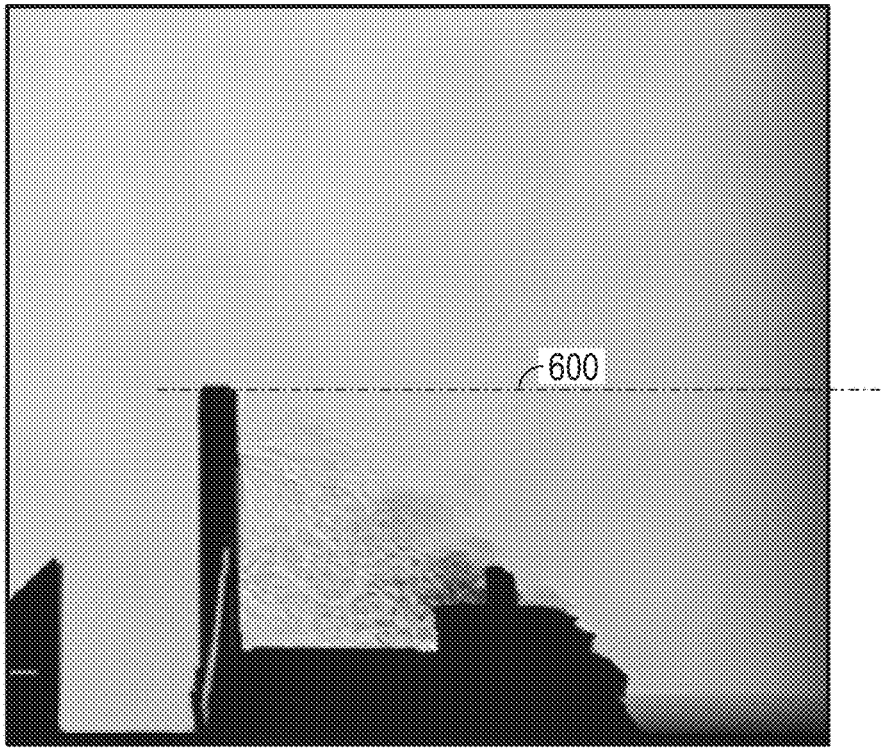
Figure 6D:
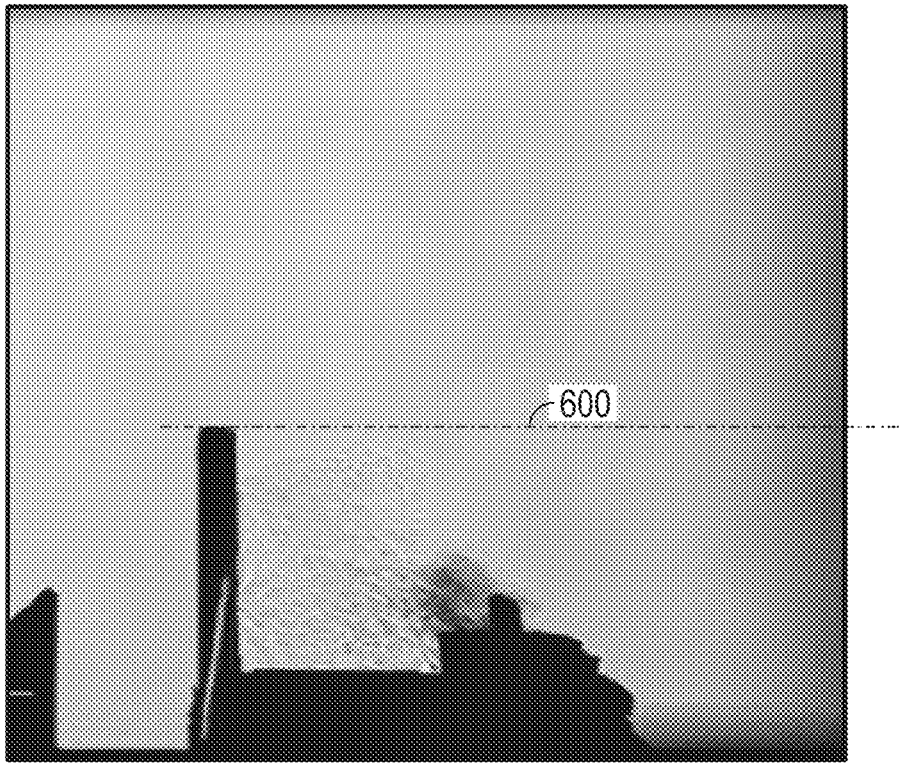
Figure 6E:
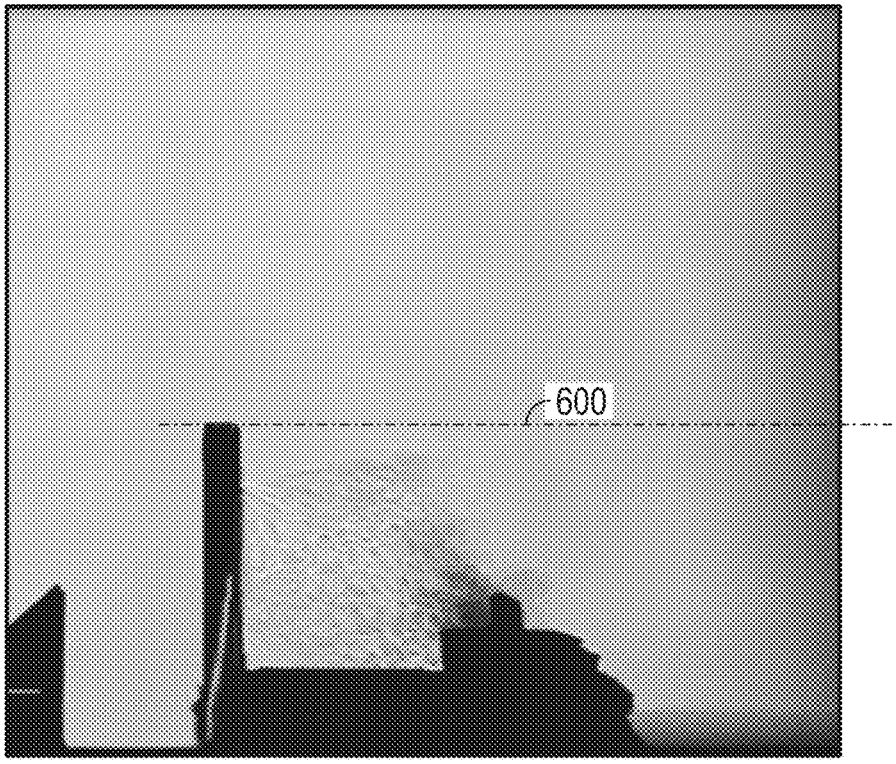
Figure 6F:
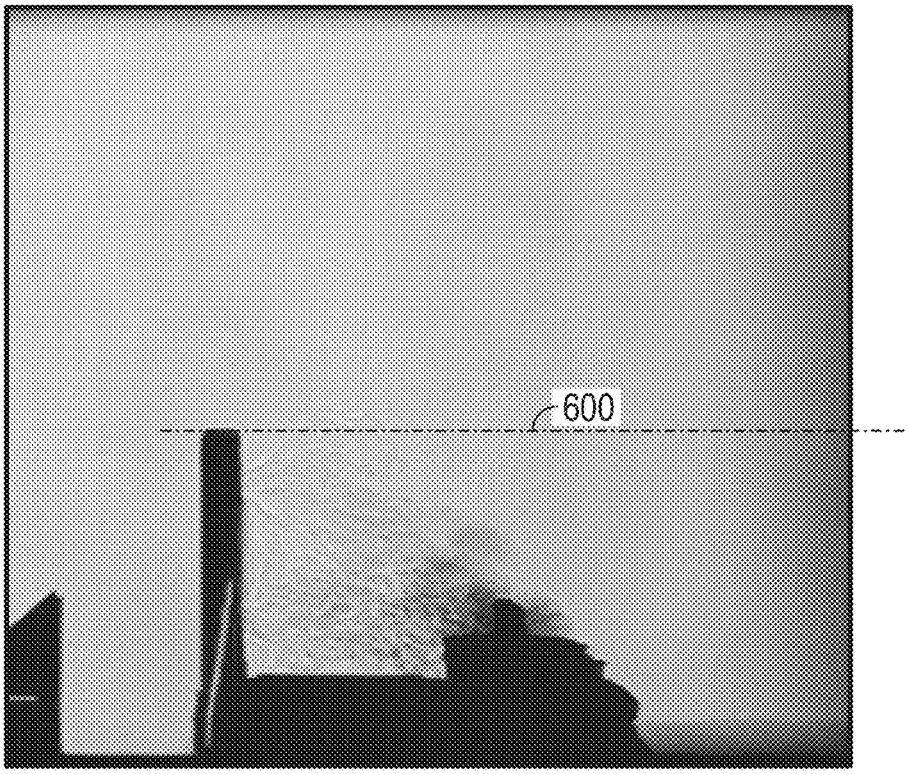

Referring now to FIG. 5 is a shadowgraph image of a test run on an actual prior art downdraft system operating to capture cooking emissions from an adjacent cooking appliance. The downdraft system of FIG. 5 includes two vents, an upper and lower vent and does not include a baffle within the chimney. In FIG. 5, the downdraft system exhibits a capture region 500 in which cooking emissions are or likely will be captured by the system. However, the downdraft system of FIG. 5 also exhibits a significant spillage region 510 in which cooking emissions are not being and likely will not be captured by the system.

FIGS. 6A-6F are shadowgraph images of a test run on an actual downdraft system in accordance with this disclosure, which is operating to capture cooking emissions from an adjacent cooking appliance. The images of FIGS. 6A-6F are still images taken from a video, which recorded the operational test of the depicted downdraft system. Each of FIGS. 6A-6F depicts the operation of the downdraft system in 10 second intervals over 1 minute of recorded video. The downdraft system of FIGS. 6A-6F is within the scope of downdraft systems in accordance with this disclosure and thus includes a vertically movable chimney with two ventilation inlets and a baffle arranged within the chimney between the two ventilation inlets. The downdraft system depicted in FIGS. 6A-6F is similar in form, function, components, and arrangement to example downdraft system 300, including baffle 330 comprised of two baffle plates 330*a*, 330*b*.

A comparison of the capture capability of the downdraft system of FIG. 5 and that of the downdraft system of FIGS. 6A-6F is indicative of the general scale of the relative improvement in capture efficiency that may be achieved by downdraft systems in accordance with this disclosure relative to other downdraft systems. While the downdraft system of FIG. 5 exhibits substantial spillage of cooking emissions, the downdraft system of FIGS. 6A-6F exhibits a substantially improved capture efficiency with the images at 40 seconds in FIG. 6D and 60 seconds in FIG. 6F appearing to show only a small amount of cooking emission spillage above the horizontal capture region datum 600. A visual inspection of the image of FIG. 5 appears to indicate a range of about 40-60% spillage of the cooking plume, while the images of FIGS. 6A-6F appear to indicate a much reduced spillage of perhaps on the order of greater than zero to 10%. Additionally, in the course of the testing from which the images of FIGS. 6A-6F are taken, the spilled effluent appearing in FIGS. 6D and 6F appeared to be drawn back down into the upper vent of the test downdraft system and this tested system therefore appeared to achieve close to 100% capture, With that said, however, FIGS. 5 and 6A-6F are provided only to provide an indication of the general scale of the relative improvement in capture efficiency that may be achieved by downdraft systems in accordance with this disclosure relative to other downdraft systems.

Figure 7:
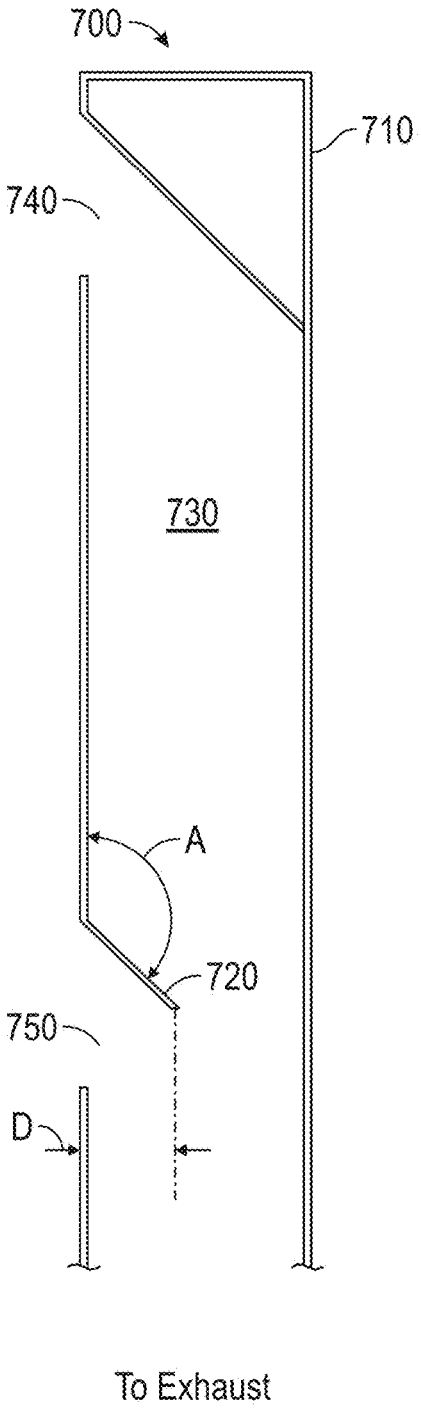
FIG. 7 is a schematic depicting a partial cross-section of another example downdraft system in accordance with this disclosure.

FIG. 7 is a schematic depicting a partial cross-section of another example downdraft system 700 in accordance with this disclosure. Referring to FIG. 7, downdraft system 700 includes a vertically moveable chimney 710 and a baffle 720. Chimney 710 defines a chamber 730 into and through which cooking emissions from a cooking appliance (not shown in FIG. 7) can be drawn to be exhausted through ventilation ducting coupled to the chimney or coupled to another portion of downdraft system 700 that is coupled to the chimney. Chimney 710 also includes two fluid inlets or vents, 740 and 750. Upper vent 740 is generally arranged vertically toward the top of chimney 710 and lower vent 750 is generally arranged vertically toward the bottom of chimney 710 in proximity/adjacent to the top of a cooking appliance. Baffle 720 is arranged within chimney 710 and disposed vertically between upper vent 740 and lower vent 750.

Example baffle 720 is an elongated, relatively thin flat plate, which is arranged within and extends laterally across (e.g., from left to right when viewing downdraft from front) chimney 710. Baffle 720 is arranged within chimney 710 at an angle A between the baffle and the inner wall of chimney 710. The extent to which baffle 720 extends into chamber 730 of chimney 710 is indicated by distance, D, in FIG. 7. The manner in which baffle 720 affects the flow of cooking emissions into and through chimney 710 depends at least in part on the angle, A, arid the distance, D. In one example, the angle A of baffle 720 is in a range from and including approximately 90 degrees to and including 150 degrees. In one example, the distance D is in a range from and including 25% of the overall depth of chimney 110 to and including 75% of the overall depth of the chimney. In the example of FIG. 7, baffle 720 is arranged vertically within chamber 730 of chimney 710 such that the end of the baffle extends down to and into the region of the chimney at which lower vent 50 is located. In another example, baffle 720 is arranged vertically within chamber 730 of chimney 710 such that the end of the baffle extends down but not into the region of the chimney at which lower vent 750 is located. In such an arrangement, baffle 720 may not be visible to an observer through lower vent 750.

Figure 8:
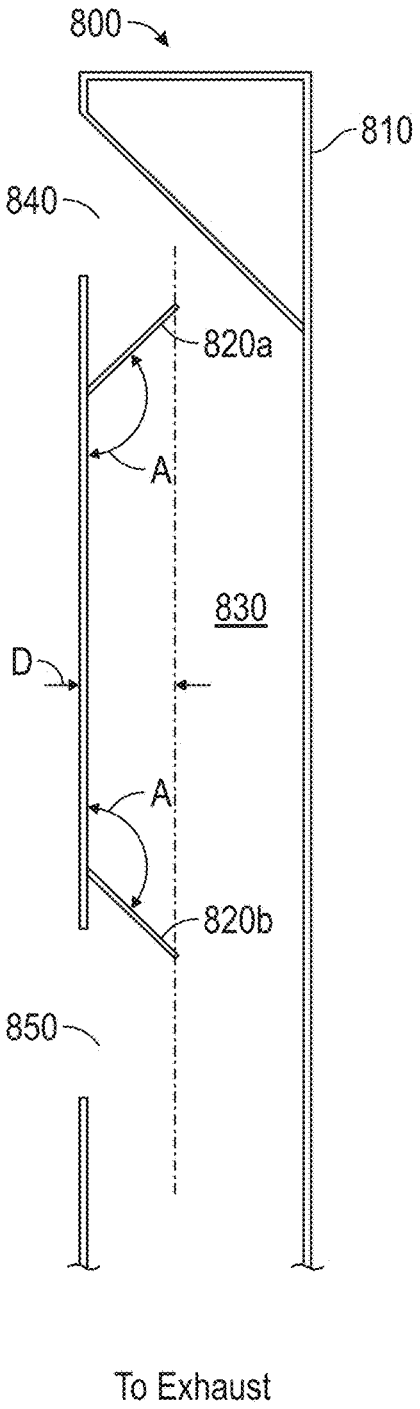
FIG. 8 is a schematic depicting a partial cross-section of another example downdraft system in accordance with this disclosure.

FIG. 8 is a schematic depicting a partial cross-section of another example downdraft system 800 in accordance with this disclosure. Referring to FIG. 8, downdraft system 800 includes a vertically moveable chimney 810 and upper and lower baffles 820*a* and 820*b*, respectively. Chimney 810 defines a chamber 830 into and through which cooking emissions from a cooking appliance (not shown in FIG. 8) can be drawn to be exhausted through ventilation ducting coupled to the chimney or coupled to another portion of downdraft system 800 that is coupled to the chimney. Chimney 810 also includes two fluid inlets or vents, 840 and 850. Upper vent 840 is generally arranged vertically toward the top of chimney 810 and lower vent 850 is generally arranged vertically toward the bottom of chimney 810 in proximity/adjacent to the top of a cooking appliance. Baffles 820*a* and 820*b* are arranged within chimney 810 and disposed vertically between upper vent 840 and lower vent 850. Upper baffle 820*a* is arranged vertically adjacent to upper vent 840. Lower baffle 820*b* is arranged vertically adjacent to lower vent 840.

Each of upper and lower baffles 820*a* and 820*b* is an elongated, relatively thin flat plate, which is arranged within and extends laterally across (e.g., from left to right when viewing downdraft from front) chimney 810. Baffles 820*a* and 820*b* both extend into chamber 830 from the front (left in the view of FIG. 8) inner wall of chimney 810. Upper baffle 820*a* is arranged within chimney 810 at an angle A between the baffle and the inner wall of chimney 810. Lower baffle 820*b* is arranged within chimney 810 at an angle B between the baffle and the inner wall of chimney 810. The extent to which baffles 820*a* and 820*b* extend into chamber 830 of chimney 810 is indicated by distance, D, in FIG. 8. In another example, upper baffle 820*a* can extend a further or shorter distance into chamber 830 than lower baffle 820*b*.

The manner in which baffles 820*a*, 820*b* affect the flow of cooking emissions into and through chimney 810 depends at least in part on the angles A and B, and the distance D. In one example, the angles A and B of upper and lower baffles 820*a* and 820*b*, respectively, is in a range from and including approximately 90 degrees to and including 150 degrees. In one example, the angles A and B are equal. In another example, angles A and B are unequal. in one example, the distance D is in a range from and including 25% of the overall depth of chimney 810 to and including 75% of the overall depth of the chimney. As illustrated, in the example of FIG. 8, baffle 820*a* is arranged vertically within chamber 830 of chimney 810 such that the end of the baffle extends up to and into the region of the chimney at which upper vent 840 is located. Baffle 820*b* is arranged vertically within chamber 830 of chimney 810 such that the end of the baffle extends down to and into the region of the chimney at which lower vent 850 is located.

Figure 9:
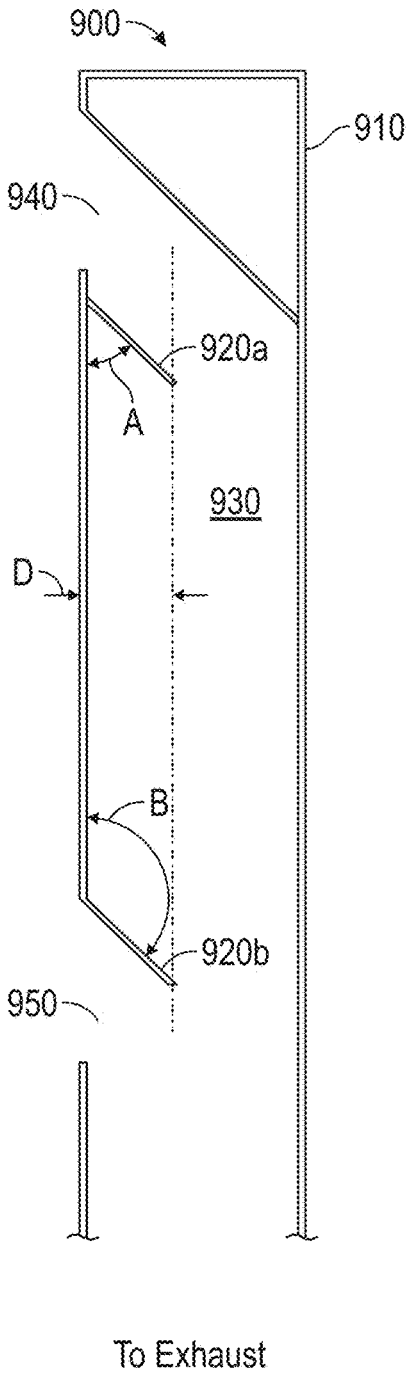
FIG. 9 is a schematic depicting a partial cross-section of another example downdraft system in accordance with this disclosure.

FIG. 9 is a schematic depicting a partial cross-section of another example downdraft system 900 in accordance with this disclosure. Referring to FIG. 9, downdraft system 900 includes a vertically moveable chimney 910 and upper and lower baffles 920*a* and 920*b*, respectively. Chimney 910 defines a chamber 930 into and through which cooking emissions from a cooking appliance (not shown in FIG. 9) can be drawn to be exhausted through ventilation ducting coupled to the chimney or coupled to another portion of downdraft system 900 that is coupled to the chimney. Chimney 910 also includes two fluid inlets or vents, 940 and 950. Upper vent 940 is generally arranged vertically toward the top of chimney 910 and lower vent 950 is generally arranged vertically toward the bottom of chimney 910 in proximity/adjacent to the top of a cooking appliance. Baffles 920*a* and 920*b* are arranged within chimney 910 and disposed vertically between upper vent 940 and lower vent 950. Upper baffle 920*a* is arranged vertically adjacent to upper vent 940. Lower baffle 920*b* is arranged vertically adjacent to lower vent 940.

Each of upper and lower baffles 920*a* and 920*b* is an elongated, relatively thin flat plate, which is arranged within and extends laterally across (e.g., from left to right when viewing downdraft from front) chimney 910. Baffles 920*a* and 920*b* both extend into chamber 930 from the front (left in the view of FIG. 9) inner wall of chimney 910. Upper baffle 920*a* is arranged within chimney 910 at an angle A between the baffle and the inner wall of chimney 910. Lower baffle 920*b* is arranged within chimney 910 at an angle B between the baffle and the inner wall of chimney 910. The extent to which baffles 920*a* and 920*b* extend into chamber 930 of chimney 910 is indicated by distance, D, in FIG. 9. In another example, upper baffle 920*a* can extend a further or shorter distance into chamber 930 than lower baffle 920*b*.

The manner in which baffles 920*a*, 920*b* affect the flow of cooking emissions into and through chimney 910 depends at least in part on the angles A and B, and the distance D. In one example, the angle A of upper baffle 920*a* is in a range from and including approximately 30 degrees to and including 90 degrees. In one example, the angle B of lower baffle 920*b* is in a range from and including approximately 90 degrees to and including 150 degrees. In one example, the distance D is in a range from and including 25% of the overall depth of chimney 910 to and including 75% of the overall depth of the chimney. As illustrated, in the example of FIG. 9, baffle 920*a* is arranged vertically within chamber 930 of chimney 910 such that the end of the baffle extends down within the chimney. Baffle 920*b* is arranged vertically within chamber 930 of chimney 910 such that the end of the baffle extends down to and into the region of the chimney at which lower vent 950 is located.

Figure 10:
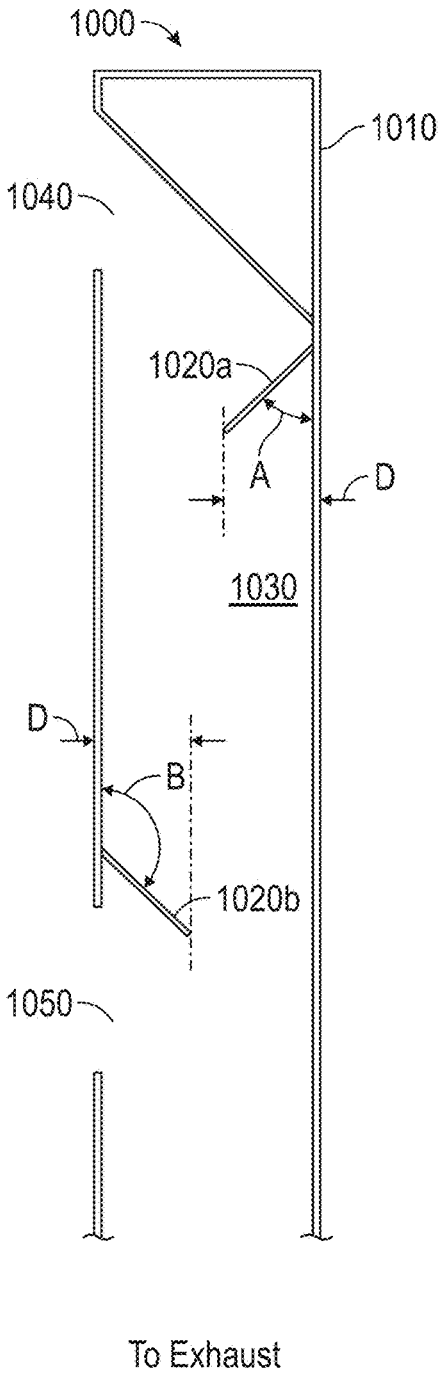
FIG. 10 is a schematic depicting a partial cross-section of another example downdraft system in accordance with this disclosure.

FIG. 10 is a schematic depicting a partial cross-section of another example downdraft system 1000 in accordance with this disclosure. Referring to FIG. 10, downdraft system 1000 includes a vertically moveable chimney 1010 and upper and lower baffles 1020*a* and 1020*b*, respectively. Chimney 1010 defines a chamber 1030 into and through which cooking emissions from a cooking appliance (not shown in FIG. 10) can be drawn to be exhausted through ventilation ducting coupled to the chimney or coupled to another portion of downdraft system 1000 that is coupled to the chimney. Chimney 1010 also includes two fluid inlets or vents, 1040 and 1050. Upper vent 1040 is generally arranged vertically toward the top of chimney 1010 and lower vent 1050 is generally arranged vertically toward the bottom of chimney 1010 in proximity/adjacent to the top of a cooking appliance. Baffles 1020*a* and 1020*b* are arranged within chimney 1010 and disposed vertically between upper vent 1040 and lower vent 1050. Upper baffle 1020*a* is arranged vertically adjacent to upper vent 1040. Lower baffle 1020*b* is arranged vertically adjacent to lower vent 1040.

Each of upper and lower baffles 1020*a* and 1020*b* is an elongated, relatively thin flat plate, which is arranged within and extends laterally across (e.g., from left to right when viewing downdraft from front) chimney 1010. Baffles 1020*a* and 1020*b* extend into chamber 1030 from opposite inner walls of chimney 1010. In other words, baffle 1020*a* extends into chamber 1030 from the back (right in the view of FIG. 10) inner wall of chimney 1010 and baffle 1020*b* extends into chamber 1030 from the front (left in the view of FIG. 10) inner wall of chimney 1010. Upper baffle 1020*a* is arranged within chimney 1010 at an angle A between the baffle and the inner, back wall of chimney 1010. Lower baffle 1020*b* is arranged within chimney 1010 at an angle B between the baffle and the inner, front wall of chimney 1010. The extent to which baffles 1020*a* and 1020*b* extend into chamber 1030 of chimney 1010 is indicated by distance, D, in FIG. 10. In another example, upper baffle 1020*a* can extend a further or shorter distance into chamber 1030 than lower baffle 1020*b*.

The manner in which baffles 1020*a*, 1020*b* affect the flow of cooking emissions into and through chimney 1010 depends at least in part on the angles A and B, and the distance D. In one example, the angle A of upper baffle 1020*a* is in a range from and including approximately 30 degrees to and including 90 degrees. In one example, the angle B of lower baffle 1020*b* is in a range from and including approximately 100 degrees to and including 150 degrees. In one example, the distance D is in a range from and including 25% of the overall depth of chimney 1010 to and including 75% of the overall depth of the chimney. As illustrated, in the example of FIG. 10, baffle 1020*a* is arranged vertically within chamber 1030 of chimney 1010 such that the end of the baffle extends down within the chimney. Additionally, the upper edge of baffle 1020*a* is arranged vertically such that the upper edge is vertically aligned or close to the lower edge of upper vent 1040. Baffle 1020*b* is arranged vertically within chamber 1030 of chimney 1010 such that the end of the baffle extends down to and into the region of the chimney at which lower vent 1050 is located.

Figure 11:
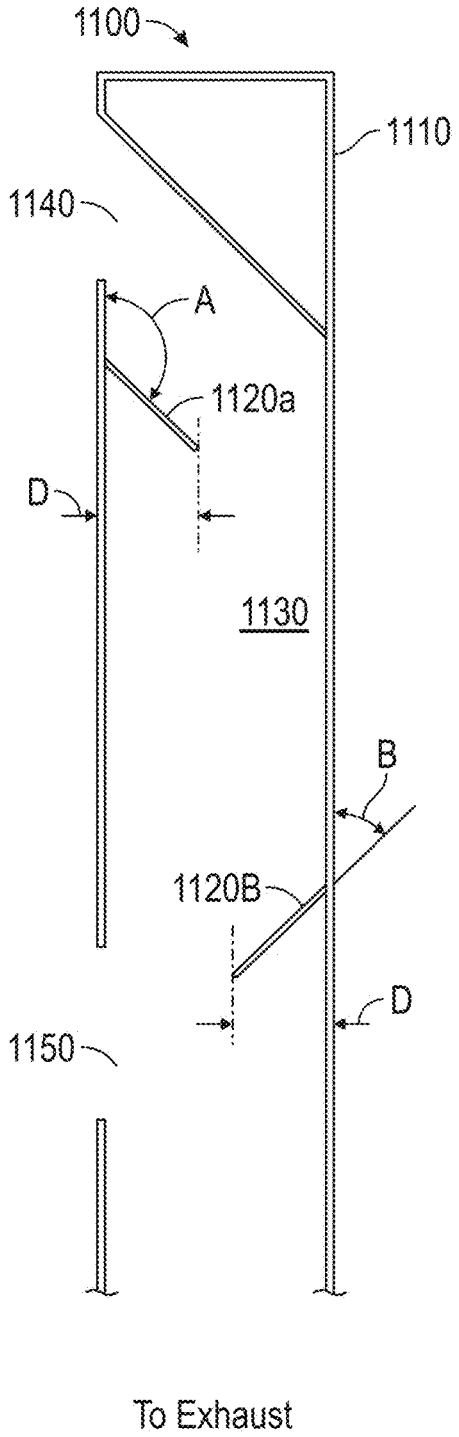
FIG. 11 is a schematic depicting a partial cross-section of another example downdraft system in accordance with this disclosure.

FIG. 11 is a schematic depicting a partial cross-section of another example downdraft system 1100 in accordance with this disclosure. Referring to FIG. 11, downdraft system 1100 includes a vertically moveable chimney 1110 and upper and lower baffles 1120*a* and 1120*b*, respectively. Chimney 1110 defines a chamber 1130 into and through which cooking emissions from a cooking appliance (not shown in FIG. 11) can be drawn to be exhausted through ventilation ducting coupled to the chimney or coupled to another portion of downdraft system 1100 that is coupled to the chimney. Chimney 1110 also includes two fluid inlets or vents, 1140 and 1150. Upper vent 1140 is generally arranged vertically toward the top of chimney 1110 and lower vent 1150 is generally arranged vertically toward the bottom of chimney 1110 in proximity/adjacent to the top of a cooking appliance. Baffles 1120*a* and 1120*b* are arranged within chimney 1110 and disposed vertically between upper vent 1140 and lower vent 1150. Upper baffle 1120*a* is arranged vertically adjacent to upper vent 1140. Lower baffle 1120*b* is arranged vertically adjacent to lower vent 1140.

Each of upper and lower baffles 1120*a* and 1120*b* is an elongated, relatively thin flat plate, which is arranged within and extends laterally across (e.g., from left to right when viewing downdraft from front) chimney 1110. Baffles 1120*a* and 1120*b* extend into chamber 1130 from opposite inner walls of chimney 1110. Baffle 1120*a* extends into chamber 1130 from the front (left in the view of FIG. 11) inner wall of chimney 1110 and baffle 1120*b* extends into chamber 1130 from the back (right in the view of FIG. 11) inner wall of chimney 1110. Upper baffle 1120*a* is arranged within chimney 1110 at an angle A between the baffle and the inner, front wall of chimney 1110. Lower baffle 1120*b* is arranged within chimney 1110 at an angle B between the baffle and the outer, back wall of chimney 1110. The extent to which baffles 1120*a* and 1120*b* extend into chamber 1130 of chimney 1110 is indicated by distance, D, in FIG. 11. In another example, upper baffle 1120*a* can extend a further or shorter distance into chamber 1130 than lower baffle 1120*b*.

The manner in which baffles 1120*a*, 1120*b* affect the flow of cooking emissions into and through chimney 1110 depends at least in part on the angles A and B, and the distance D. In one example, each angle A and B of upper and lower baffles 1120*a* and 1120*b* is in a range from and including approximately 30 degrees to and including 90 degrees. In another example, the angles A and B of upper and lower baffle 1120*a* and 1120*b* are unequal. In one example, the distance D is in a range from and including 25% of the overall depth of chimney 1110 to and including 75% of the overall depth of the chimney. As illustrated, in the example of FIG. 11, baffle 1120*a* is arranged vertically within chamber 1130 of chimney 1110 such that the end of the baffle extends up to and into the region of the chimney at which upper vent 1140 is located. Baffle 1120*b* is arranged vertically within chamber 1130 of chimney 1110 such that the end of the baffle extends down to and into the region of the chimney at which lower vent 1150 is located.

Similar to the example of FIG. 3, the baffles described with reference to all of the examples of FIGS. 7-11 can be a single, integral component or maybe formed of multiple separate and/or connected components. For example, the baffle 720 can include a single elongated plate that extends across part or all of the width of chimney 710. In another example, however, baffle 720 can include multiple elongated plates that are vertically aligned and distributed part of all of the way across the width of chimney 710.This concept can also be applied mutatis mutandis to each of baffles 820*a*, 820*b*, 920*a*, 920*b*, 1020*a*, 1020*b*, 1120*a* and 1120*b* of FIGS. 8, 9, 10 and 11, respectively.

Figure 12:
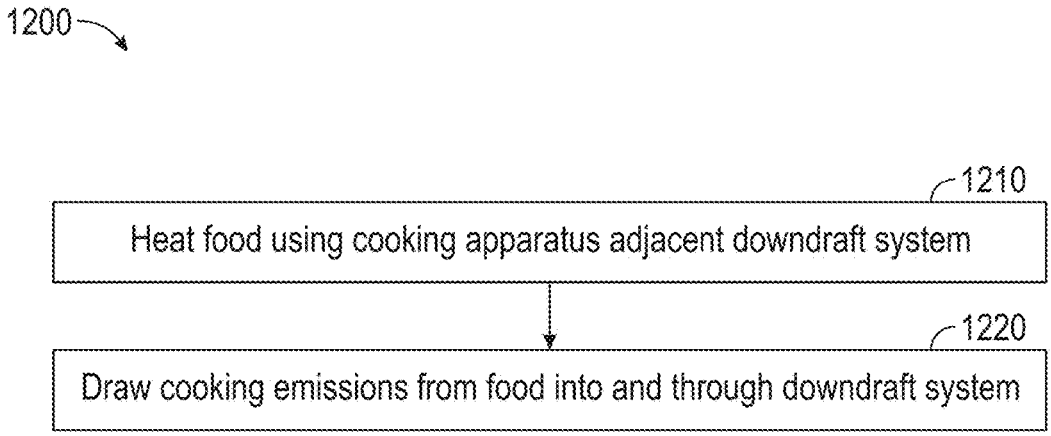
FIG. 12 is a flowchart depicting an example method in accordance with this disclosure.

FIG. 12 is a flowchart depicting an example method 1200 in accordance with this disclosure. Method 1200 includes heating food using a cooking apparatus arranged adjacent a downdraft ventilation system (1210) and drawing part or all of cooking emissions from the food into and through the downdraft system (1220). For example, a food product can be heated in a pan or pot on top of an electric, gas, or induction cooktop cooking apparatus. A byproduct of heating the food is cooking emissions that emanate from the food, as it is being heated by the cooking apparatus. The downdraft system can be any of the example downdraft systems described above, combinations thereof, or another example downdraft system in accordance with this disclosure. For example, the downdraft system can include a moveable chimney with an upper vent and a lower vent, the chimney defining a flow path into and through which the cooking emissions flow. The downdraft system can also include at least one baffle arranged within the chimney between the upper and lower vent. An air/emissions movement assembly including, for example, a blower fan can draw cooking emissions from the food into and through the upper and lower vents, through the chimney, and across the baffle(s) toward an outlet of the chimney. The cooking emissions can thereafter be exhausted within or without the space within which the downdraft system and cooking appliance are arranged.

The above examples include a downdraft system with a chimney that includes two (or more) ventilation inlets and an internal baffle arranged within the chimney. However, another example in accordance with this disclosure and consistent in form, function, arrangement, etc. of the above-described examples can include a chimney with a single ventilation inlet and internal baffle arranged within the chimney. The baffle (including a baffle comprised of a single, integral component or multiple components) employed in a single ventilation inlet system can be substantially similar in shape, size, function, and arrangement as the baffles described in the above examples. The advent of the internal baffle in a downdraft system with one ventilation inlet may advantageously affect the capture capacity of the system.

VARIOUS NOTES & EXAMPLES

Example 1 can include A downdraft ventilation system comprising: a moveable chimney comprising an upper vent and a lower vent, the chimney defining a flow path into and through which cooking emissions emanating from a cooking appliance adjacent to the chimney can flow; and at least one baffle arranged within the chimney between the upper and lower vent.

Example 2 can include, or can optionally be combined with the subject matter of Example 1, to optionally include the at least one baffle comprising an elongated plate arranged laterally within and extending at least partially across a width of the chimney, the plate comprising a curved middle section connected to upper and lower sections.

Example 3 can include, or can optionally be combined with the subject matter of Examples 1 and/or 2, to optionally include the plate defining a convergent, a throat, and a divergent flow path section within the chimney.

Example 4 can include, or can optionally be combined with the subject matter of Examples 1 and/or 3, to optionally include an angle between the upper section of the baffle and an inner wall of the chimney in a range from and including 30 degrees to and including 40 degrees.

Example 5 can include, or can optionally be combined with the subject matter of Examples 1 and/or 3, to optionally include an angle between the upper section of the baffle and an inner wall of the chimney is approximately equal to 33 degrees.

Example 6 can include, or can optionally be combined with the subject matter of Examples 1 and/or 3, to optionally include an angle between the lower section of the baffle and the inner wall of the chimney in a range from and including 5 degrees to and including 15 degrees.

Example 7 can include, or can optionally be combined with the subject matter of Examples 1 and/or 3, to optionally include an angle between the lower section of the baffle and the inner wall of the chimney is approximately equal to 11 degrees.

Example 8 can include, or can optionally be combined with the subject matter of Examples 1 and/or 3, to optionally include the baffle extending from the inner wall of the chimney by a distance in a range from and including 25% to and including 75% of a total depth of the chimney.

Example 9 can include, or can optionally be combined with the subject matter of Example 1, to optionally include the at least one baffle comprising a first and a second elongated plate, each of the first and second elongated plates being arranged laterally within and extending at least partially across a width of the chimney, each of the first and second elongated plates comprising a curved middle section connected to upper and lower sections.

Example 10 can include, or can optionally be combined with the subject matter of Examples 1 and/or 9, to optionally include each of the first and second plates defining a convergent, a throat, and a divergent flow path section within the chimney.

Example 11 can include, or can optionally be combined with the subject matter of Examples 1, 9 and/or 10, to optionally include an angle between the upper section of each of the first and second plates and an inner wall of the chimney is in a range from and including 30 degrees to and including 40 degrees.

Example 12 can include, or can optionally be combined with the subject matter of Examples 1, 9 and/or 10, to optionally include an angle between the upper section of the baffle and an inner wall of the chimney is approximately equal to 33 degrees.

Example 13 can include, or can optionally be combined with the subject matter of Examples 1, 9 and/or 10, wherein an angle between the lower section of each of the first and second plates and the inner wall of the chimney is in a range from and including 5 degrees to and including 15 degrees.

Example 14 can include, or can optionally be combined with the subject matter of Examples 1, 9 and/or 10, to optionally include an angle between the lower section of the baffle and the inner wall of the chimney is approximately equal to 11 degrees.

Example 15 can include, or can optionally be combined with the subject matter of Examples 1, 9 and/or 10, to optionally include each of the first and second plates extends from the inner wall of the chimney by a distance in a range from and including 25% to and including 75% of a total depth of the chimney.

Example 16 can include, or can optionally be combined with the subject matter of Examples 1 and/or 9, to optionally include the first plate is arranged on one side of a lateral middle axis of the chimney and wherein the second plate is arranged on an opposite side of the lateral middle axis of the chimney.

Example 17 can include, or can optionally be combined with the subject matter of Examples 1, 9 and/or 16, to optionally include that the first plate does not extend laterally across the lateral middle line of the chimney.

Example 18 can include, or can optionally be combined with the subject matter of Examples 1, 9, 17 and/or 17, to optionally include that the second plate does not extend laterally across the lateral middle line of the chimney.

Example 19 can include, or can optionally be combined with the subject matter of Examples 1, to optionally include that at least one baffle comprises an elongated flat plate arranged laterally within and extending at least partially across a width of the chimney.

Example 20 can include, or can optionally be combined with the subject matter of Examples 1 and/or 19, to optionally include that at least one baffle is arranged adjacent the lower vent.

Example 21 can include, or can optionally be combined with the subject matter of Examples 1 and/or 19, to optionally include an angle between the baffle and an inner wall of the chimney is in a range from and including 90 degrees to and including 150 degrees.

Example 22 can include, or can optionally be combined with the subject matter of Examples 1 and/or 19, to optionally include that the baffle extends from the inner wall of the chimney by a distance in a range from and including 25% to and including 75% of a total depth of the chimney.

Example 23 can include, or can optionally be combined with the subject matter of Example 1, to optionally include a first baffle comprising an elongated flat plate arranged laterally within and extending at least partially across a width of the chimney, the first baffle being arranged adjacent the upper vent; and a second baffle comprising an elongated flat plate arranged laterally within and extending at least partially across a width of the chimney, the second baffle being arranged adjacent the lower vent.

Example 24 can include, or can optionally be combined with the subject matter of Examples 1 and/or 23, to optionally include a first angle between the first baffle and an inner wall of the chimney is a range from and including 90 degrees to and including 150 degrees.

Example 25 can include, or can optionally be combined with the subject matter of Examples 1 and/or 23, to optionally include a second angle between the second baffle and the inner wall of the chimney is in a range from and including 90 degrees to and including 150 degrees.

Example 26 can include, or can optionally be combined with the subject matter of Examples 1 and/or 23, to optionally include each of the first and second baffles extends from the inner wall of the chimney by a distance in a range from and including 25% to and including 5% of a total depth of the chimney.

Example 27 can include, or can optionally be combined with the subject matter of Examples 1 and/or 23, to optionally include each of the first baffle and the second baffle extends into the chimney from an inner wall of the chimney.

Example 28 can include, or can optionally be combined with the subject matter of Examples 1 and/or 23, to optionally include that the first baffle extends into the chimney from a first inner wall of the chimney and the second baffle extends into the chimney from a second inner wall of the chimney that is opposite the first inner wall.

Example 29 can include heating food using a cooking apparatus arranged adjacent a downdraft ventilation system, a byproduct of the heating being cooking emissions that emanate from the food, the downdraft ventilation system comprising a moveable chimney comprising an upper vent and lower vent, the chimney defining a flow path into and through which at least a portion of the cooking emissions flow; and at least one baffle arranged within the chimney between the upper and lower vent; and drawing at least a portion of the cooking emissions from the food into and through the upper and lower vent, through the chimney, and across the baffle toward an outlet of the chimney.

Various examples have been described. These and other examples are within the scope of the following claims.

The invention claimed is:

1. A downdraft ventilation system comprising:

a moveable chimney comprising an upper fluid inlet and a lower fluid inlet, the chimney upper and lower fluid inlets defining a flow path into which cooking emissions emanating from a cooking appliance adjacent to the chimney can flow; and at least one baffle arranged within the chimney between the upper and lower fluid inlets and comprising an elongated plate arranged laterally within and extending at least partially across a width of the chimney, the plate comprising a curved middle section connected to upper and lower sections.

2. The system of claim 1, wherein the plate defines a convergent, a throat, and a divergent flow path section within the chimney.

3. The system of claim 2, wherein an angle between the upper section of the baffle and an inner wall of the chimney is in a range from and including 30 degrees to and including 40 degrees.

4. The system of claim 2, wherein an angle between the upper section of the baffle and an inner wall of the chimney is approximately equal to 33 degrees.

5. The system of claim 2, wherein an angle between the lower section of the baffle and the inner wall of the chimney is in a range from and including 5 degrees to and including 15 degrees.

6. The system of claim 2, wherein an angle between the lower section of the baffle and the inner wall of the chimney is approximately equal to 11 degrees.

7. The system of claim 2, wherein the baffle extends from an inner wall of the chimney by a distance in a range from and including 25% to and including 75% of a total depth of the chimney.

8. The system of claim 1, wherein the at least one baffle comprises a first and a second elongated plate, each of the first and second elongated plates being arranged laterally within and extending at least partially across a width of the chimney, each of the first and second elongated plates comprising a curved middle section connected to upper and lower sections.

9. The system of claim 8, wherein each of the first and second plates defines a convergent, a throat, and a divergent flow path section within the chimney.

10. The system of claim 9, wherein an angle between the upper section of each of the first and second plates and an inner wall of the chimney is in a range from and including 30 degrees to and including 40 degrees.

11. The system of claim 9, wherein an angle between the upper section of the baffle and an inner wall of the chimney is approximately equal to 33 degrees.

12. The system of claim 9, wherein an angle between the lower section of each of the first and second plates and the inner wall of the chimney is in a range from and including 5 degrees to and including 15 degrees.

13. The system of claim 9, wherein an angle between the lower section of the baffle and the inner wall of the chimney is approximately equal to 11 degrees.

14. The system of claim 9, wherein each of the first and second plates extends from the inner wall of the chimney by a distance in a range from and including 25% to and including 75% of a total depth of the chimney.

15. The system of claim 8, wherein the first plate is arranged on one side of a lateral middle axis of the chimney and wherein the second plate is arranged on an opposite side of the lateral middle axis of the chimney.

16. The system of claim 15, wherein the first plate does not extend laterally across the lateral middle line of the chimney.

17. The system of claim 16, wherein the second plate does not extend laterally across the lateral middle line of the chimney.

18. The system of claim 1, wherein the at least one baffle comprises an elongated flat plate arranged laterally within and extending at least partially across a width of the chimney.

19. The system of claim 18, wherein the at least one baffle is arranged adjacent the lower fluid inlet.

20. The system of claim 18, wherein an angle between the baffle and an inner wall of the chimney is in a range from and including 90 degrees to and including 150 degrees.

21. The system of claim 18, wherein the baffle extends from an inner wall of the chimney by a distance in a range from and including 25% to and including 75% of a total depth of the chimney.

22. The system of claim 1, wherein the at least one baffle comprises:

a first baffle comprising an elongated flat plate arranged laterally within and extending at least partially across a width of the chimney, the first baffle being arranged adjacent the upper fluid inlet; and a second baffle comprising an elongated flat plate arranged laterally within and extending at least partially across a width of the chimney, the second baffle being arranged adjacent the lower fluid inlet.

23. The system of claim 22, wherein a first angle between the first baffle and an inner wall of the chimney is in a range from and including 90 degrees to and including 150 degrees.

24. The system of claim 22, wherein a second angle between the second baffle and an inner wall of the chimney is in a range from and including 90 degrees to and including 150 degrees.

25. The system of claim 22, wherein each of the first and second baffles extends from an inner wall of the chimney by a distance in a range from and including 25% to and including 75% of a total depth of the chimney.

26. The system of claim 22, wherein each of the first baffle and the second baffle extends into the chimney from an inner wall of the chimney.

27. The system of claim 22, wherein the first baffle extends into the chimney from a first inner wall of the chimney and the second baffle extends into the chimney from a second inner wall of the chimney that is opposite the first inner wall.

28. A downdraft ventilation system comprising:

a moveable chimney comprising an upper fluid inlet and a lower fluid inlet, the chimney upper and lower fluid inlets defining a flow path into which cooking emissions emanating from a cooking appliance adjacent to the chimney can flow; and at least one baffle arranged within the chimney between the upper and lower fluid inlets and comprising a first and a second elongated plate, each of the first and second elongated plates being arranged laterally within and extending at least partially across a width of the chimney, each of the first and second elongated plates comprising a curved middle section connected to upper and lower sections.

29. A downdraft ventilation system comprising:

a moveable chimney comprising an upper fluid inlet and a lower fluid inlet, the chimney upper and lower fluid inlets defining a flow path into which cooking emissions emanating from a cooking appliance adjacent to the chimney can flow; and at least one baffle arranged within the chimney between the upper and lower fluid inlets, the at least one baffle comprising:

a first baffle comprising an elongated flat plate arranged laterally within and extending at least partially across a width of the chimney, the first baffle being arranged adjacent the upper fluid inlet; and a second baffle comprising an elongated flat plate arranged laterally within and extending at least partially across a width of the chimney, the second baffle being arranged adjacent the lower fluid inlet.

30. A downdraft ventilation system comprising:

a moveable chimney comprising an upper fluid inlet and a lower fluid inlet, the chimney upper and lower fluid inlets defining a flow path into which cooking emissions emanating from a cooking appliance adjacent to the chimney can flow; and at least one baffle arranged within the chimney between the upper and lower fluid inlets and arranged adjacent the lower fluid inlet, the at least one baffle comprising an elongated flat plate arranged laterally within and extending at least partially across a width of the chimney.

31. A downdraft ventilation system comprising:

a moveable chimney comprising an upper fluid inlet and a lower fluid inlet, the chimney upper and lower fluid inlets defining a flow path into which cooking emissions emanating from a cooking appliance adjacent to the chimney can flow; and at least one baffle arranged within the chimney between the upper and lower fluid inlets and comprising an elongated flat plate arranged laterally within and extending at least partially across a width of the chimney and an angle between the baffle and an inner wall of the chimney is in a range from and including 90 degrees to and including 150 degrees.

32. A downdraft ventilation system comprising:

a moveable chimney comprising an upper fluid inlet and a lower fluid inlet, the chimney upper and lower fluid inlets defining a flow path into which cooking emissions emanating from a cooking appliance adjacent to the chimney can flow; and at least one baffle arranged within the chimney between the upper and lower fluid inlets and comprising an elongated flat plate arranged laterally within and extending at least partially across a width of the chimney and the baffle extends from an inner wall of the chimney by a distance in a range from and including 25% to and including 75% of a total depth of the chimney.

* * * * *